United States Patent [19]

Franklin

[11] Patent Number: 4,634,625

[45] Date of Patent: Jan. 6, 1987

[54] NEW FABRICS, YARNS AND PROCESS

[75] Inventor: John S. Franklin, Wilmington, Del.

[73] Assignee: E. I. Du Pont de Nemours and Company, Wilmington, Del.

[21] Appl. No.: 664,803

[22] Filed: Oct. 25, 1984

[51] Int. Cl.[4] ..... B05D 1/36; B05D 5/00; D02G 3/00; D02D 15/00

[52] U.S. Cl. ..... 428/258; 139/420 R; 139/426 R; 428/257; 428/259; 428/369; 428/397; 57/247; 57/248; 57/254; 57/256

[58] Field of Search ..... 428/397, 369, 225, 258, 428/259, 257; 57/248, 247, 254, 256; 139/383 B, 383 R, 420 R, 420 A, 426 R

[56] References Cited

U.S. PATENT DOCUMENTS

| | | | |
|---|---|---|---|
| 3,698,177 | 10/1972 | Nyfeler . | |
| 3,771,307 | 11/1973 | Petrille . | |
| 3,772,872 | 11/1973 | Piazza et al. . | |
| 3,846,969 | 11/1974 | Mckay | 57/248 X |
| 3,914,488 | 10/1975 | Gorrafa | 428/397 |
| 4,041,689 | 8/1977 | Duncan et al. | 57/248 |
| 4,058,967 | 11/1977 | Iimuro et al. | 428/397 X |
| 4,118,529 | 10/1978 | Nakagawa et al. | 428/259 X |
| 4,134,882 | 1/1979 | Frankfort et al. . | |
| 4,195,051 | 3/1980 | Frankfort et al. . | |
| 4,342,565 | 8/1982 | Teague et al. | 428/259 X |

*Primary Examiner*—Lorraine T. Kendell

[57] ABSTRACT

Scalloped-oval cross-section for low denier filaments of partially-oriented polyester for new draw-texturing feed yarn, and a new process of draw-texturing to prepare corresponding polyester textured yarns for use in combination spun yarn/textured polyester yarn fabrics, and such combination and other new fabrics.

4 Claims, 15 Drawing Figures

NEW FABRICS, YARNS AND PROCESS

DESCRIPTION

1. Technical Field

This invention relates to new polyester draw-texturing feed yarns, to a process for draw-texturing such feed yarns, whereby textured yarns can be obtained having useful characteristics such that fabrics may be obtained with new aesthetics, and to the new fabrics.

2. Background Art

Partially-oriented polyester draw-texturing feed yarns and a process for false-twist draw-texturing such yarns to prepare textured polyester yarns are known, e.g., from U.S. Pat. Nos. 3,771,307 (Petrille) and 3,772,872 (Piazza & Reese), and have been used commercially in very large quantities over the past two decades. The commercial objective has always been to provide fabrics having natural (hitherto essentially cotton-like) aesthetics, but by using textured polyester yarns instead of spun yarns. The term "spun yarns" is used herein in the sense of yarns made by twisting together staple fibers, such yarns being obtained by processing tow or staple fiber, e.g., according to the cotton system or a modern derivative therefrom. Such processing into spun yarn has generally required several stages and has been more expensive than making false-twist-textured yarns. The terms "textured" and "draw-texturing" are used hereinafter to refer to the technique involving false-twist, which technique is used today by almost all throwsters, and is responsible for more than 95% of the volume of textured polyester yarn produced in the U.S.A. Apart from lower cost, the use of continuous filament yarn imparts an important advantage in wash-wear wrinkling performance and stretch to the resulting fabrics. Additionally, spun yarns often pill, so their fabrics become unsightly and lose fiber during wear.

Initially, such draw-texturing feed yarns used to comprise mostly filaments of round cross-section. A round cross-section is not now so popular because it tends to produce fabrics having less desirable aesthetics, such as a slick hand or feel, and glitter. Glitter is believed to result from reflection of flashes of light from flat surfaces of the textured filaments, these flat surfaces being caused by deformation during draw-texturing.

Advantages of using texturing feed yarns of non-round cross-section have been known for many years, as taught, e.g., by Nyfeler U.S. Pat. No. 3,698,177, who recommended the use of a multi-lobal cross-section, especially a trilobal cross-section. Later, Duncan & Scrivener U.S. Pat. No. 4,041,689 taught the use of draw-texturing feed yarns having cross-sections with more lobes, namely 6 to 10 lobes of equal length, and particularly octalobal yarns. Duncan and Scrivener taught that the use of low denier (less than 3.8) textured filaments was to be avoided because of the poor tactile aesthetic properties of the resulting fabrics, but that, if the denier is less than 3.8 after drawing, it may be possible to produce a glitter-free yarn from filaments having round or multi-lobal cross-sections. The use of such essentially symmetrical octa-lobal feed yarns seemed to solve the glitter problem in fabrics, and so such yarns have become more popular, but customers still seem to prefer fabrics from spun yarns over fabrics from textured yarns. Also, fabrics with an enhanced, but pleasing, luster are desired. Thus, there is still a need for significant improvement in fabrics, and in the processes and/or feed yarns used.

I have investigated the use of textured polyester in combination with spun yarns in so called combination fabrics (often referred to as "combos") wherein the textured yarn is used as the warp and the spun yarn is woven as the filling or vice versa. However, use of prior art textured polyester yarns did not produce fabrics having the desired aesthetics, so an improved yarn has now been provided, according to the invention, whereby improved combo fabrics can be provided with novel desirable aesthetics.

DISCLOSURE OF THE INVENTION

There is provided according to the present invention an improved polyester draw-texturing feed yarn, comprising poly(ethylene terephthalate) continuous filaments of non-round cross-section, having an elongation to break of about 80 to 180% and a tenacity of at least 2 grams per denier, the improvement characterized in that the filaments are of scalloped-oval cross-section, and of denier per filament such that the resulting draw-textured yarns have a denier per filament of about 1 to about 4.5, and preferably about 1 to about 2.5, and an improved process for draw-texturing such partially-oriented feed yarns at a draw ratio of between about 1.3× and about 2×.

The draw-texturing process is conventional except for the use of the new yarns, and that use of low bulking conditions is preferred to minimize distortion of the new cross-section. Such conditions will be understood readily by those skilled in the art. The denier per filament (dpf) is reduced during draw-texturing, in proportion to the draw ratio used. Thus the dpf of a feed yarn is always calculated according to the dpf desired in the resulting draw-textured yarn, having regard to the draw-ratio that will be used, and the amount of relaxation allowed. The draw-ratio depends on the conditions of partially-oriented feed yarn preparation, especially the speed of withdrawal during extrusion (high speed spinning), as is well-known in the art. Such feed yarns are usually designated in the trade by the denier of both feed and textured yarns, e.g. 175 (110)-68 indicates a feed yarn of 68 filaments with a spun nominal denier of 175 for draw-texturing down to a textured nominal denier of 110, i.e., a feed yarn of dpf about 2.6 and a textured yarn of dpf about 1.6.

A low dpf is preferred for the textured yarns to minimize glitter in the fabrics as will become clear from the comparison later. By maintaining such low dpf, the desired result of enhanced luster without glitter can be obtained when using the unique scalloped-oval cross-section in the partially oriented feed yarns of the invention. However, too low a dpf leads to limp unattractive fabrics.

The importance of a reasonably high elongation (elongation to break of 80 to 180% and tenacity of at least 2 gpd) is well known already for partially-oriented polyester draw-texturing feed yarns. The elongation is a measure of the orientation, which should be sufficiently high that the feed yarn is stable to storage and can be strung up on the heater of a draw-texturing machine. However, the orientation should not be so high as to increase the crystallinity of the feed yarn, since draw-texturing of too crystalline a feed yarn is not desired; thus very high spinning speeds are not generally desirable according to the invention.

Drawn filaments having a similar scalloped-oval cross-section, of denier 2 to 14, are already known from Gorrafa U.S. Pat. No. 3,914,488. These were suggested for use in fur-like fabrics, for which purpose the filaments were formed into a tow and cut to staple. We believe that such a filament cross-section has not previously been suggested for use as a multifilament partially-oriented yarn for draw-texturing and then use as a continuous filament yarn in woven or knitted fabrics, especially combo fabrics.

The feed yarns of the invention are made by conventional techniques, by spinning partially-oriented yarns, preferably at speeds of about 3000 to 4500 ypm, and providing the yarns with a finish suitable for draw-false-twist-texturing as disclosed in Piazza et al. U.S. Pat. No. 3,772,872. No novel techniques are required for making filaments of scalloped-oval cross-section, but the known techniques for making filaments of non-round cross-section (using different spinning speeds) as described by Gorrafa U.S. Pat. No. 3,914,488 or by Frankfort et al. in U.S. Pat. Nos. 4,195,051 and 4,134,882, may be modified, or the teachings of prior art methods of making other non-round cross-sections, e.g., Duncan & Scrivener U.S. Pat. No. 4,041,689, may be modified appropriately. Frankfort et al. teach in Example 46 the making of a yarn having a low elongation to break of 49%, comprising filaments of scalloped-oval cross-section, by spinning at a speed of 6,000 ypm, which provides more crystalline yarns, and is much too high to make the partially-oriented feed yarns of higher elongation of the invention. Frankfort et al. disclose elsewhere that yarns of low elongation prepared by spinning at these very high speeds may be used as feed yarns for draw-texturing and can give textured yarns of improved dyeability over textured yarns prepared from partially-oriented feed yarn. There is no disclosure of draw-texturing the scalloped-oval cross-section filament yarns of Example 46, nor any teaching of any special advantage that can be obtained by using textured yarns of any particular cross-section or denier.

There are also provided, according to the invention, fabrics comprising textured continuous filament polyester yarns, whose filaments are derived by draw-texturing feed yarn filaments of scalloped-oval cross-section, especially improved combination (combo) woven fabrics, comprising textured continuous filament polyester warp yarns in combination with spun filling yarns, or comprising spun warp yarns in combination with textured continuous filament polyester filling yarns, the improvement in either case being characterized by using textured filaments of denier about 1 to about 4.5, preferably about 1 to about 2.5, and of textured scalloped-oval cross-section, i.e., derived by draw-texturing feed yarn filaments of scalloped-oval cross-section, as textured continuous filament polyester yarns in such fabrics. Such fabrics are prepared by conventional techniques, except for the use of the novel textured yarns in place of conventional textured yarns, and the advantages derived thereby, especially in the combo fabrics, and especially using filaments in the preferred denier range of about 1 to 2.5, can be seen from the Examples hereinafter.

BRIEF DESCRIPTION OF DRAWINGS

Gorrafa U.S. Pat. No. 3,914,488 discloses parameters for a scalloped-oval cross-section and FIG. 1 is essentially as shown therein. Thus, a scalloped-oval is of essentially oval shape, with a significant difference between the lengths of major and minor axes, and differs significantly from prior art round and multi-lobal filaments in this respect, so that it would be misleading herein to consider all four rounded portions of the scalloped-oval as lobes (as did Gorrafa) in view of the terminology used in other prior art for symmetrical multilobal cross-sections. However, preferred dimensions, essentially as described by Gorrafa, may be characterized as follows:

Figure 1:
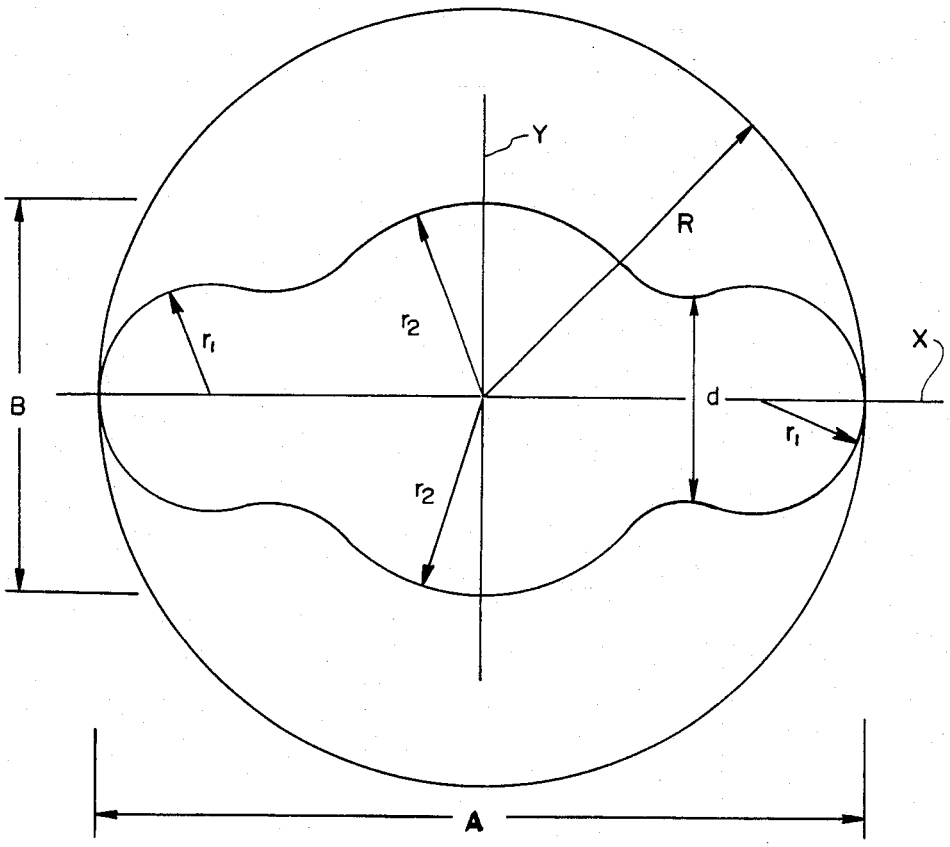
FIG. 1 shows a scalloped-oval cross-section for a stylized filament of a feed yarn according to the invention.

Considering FIG. 1, the cross-sectional configuration of fibers may be determined from a photomicrograph of the fiber cross-section.

The length of cross-section along the major axis X is indicated by A, which is also 2R, the circumscribing radius for the cross-section. The width of the cross-section along the minor axis Y is indicated by B. The ratio of length to width of the cross-section is A/B.

In the melt-spinning of filaments, the polymer tends to flow so as to produce smooth curves or combinations of smooth curves and straight lines in the periphery of the cross-section. For the purpose of measurement, the periphery may be considered to be composed of straight lines and arcs of circles. Using this concept, filaments of the invention have a lobe located at each end of the major cross-sectional axis, the extreme portion of the lobe being an arc of a circle, and being preferably more than a semicircle. The radius of each lobe tip is indicated by $r_1$. Likewise, at each end of the minor axis Y of the cross-section, there is another arc, whose radius is indicated by $r_2$. While FIG. 1 shows the centers of curvature for both arcs at the same point on the minor axis, this is not essential. The centers of curvature may be separated, for example, as described by Gorrafa. The tip radius ratio for the lobes on the major axis is $r_1/R$ and for the extremities of the minor axis is $r_2/R$.

Another feature of the cross-section is the distance d which is the distance between two scallopings measured across the major axis of the fiber cross-section, as described by Gorrafa.

Preferably, dimensions are in approximately the following proportions:—the ratio of length to width A/B of the cross-section from 1.4 to 2.4, tip radius ratio $r_1/R$ for the lobes on the major axis between 0.20 and 0.45, and the tip radius ratio $r_2/R$ on the minor axis from 0.8 to 2.1 times the tip radius ratio $r_1/R$. The cross-section must be properly scalloped to provide the desirable properties of the invention; for this reason, the ratio $d/2r_1$, is preferably from about 0.6 to 1.0.

While the above features may appear to be complicated, they are quite simple to measure on enlarged photomicrographs of cross-sectional views.

These preferred dimensions are very different from those recommended for more extended cross-sections of propeller cross-section, which, upon texturing, would have the disadvantage of deforming to give flattened sections that would result in glitter, and which might fibrillate, even before texturing. Fibrillation is not desired, because this would give entirely different aesthetics, namely fuzz and frosting in the fabric, and could give processing problems.

The scalloped-oval cross-section has a capability of providing low denier filaments with a combination of a pleasing hand and an enhanced luster but without an undesirable amount of glitter. This combination seems unique in my experience in fabric aesthetics with textured yarns. This enables one skilled in the art to design fabrics with greater versatility than heretofore, varying for example the content of delusterant ($TiO_2$), the denier and number of filaments, the fabric construction, the content of the spun yarn, and optionally reducing the dpf still further, e.g., by caustic treatment of the fabric.

The invention is further illustrated in the following Examples. In these Examples, and elsewhere herein, reference is made to several measurements of yarn properties, such as tensile properties (tenacity and elongation-to-break), relative viscosity and crimp contraction values ($CCA_5$), which are measured according to the methods described in Frankfort et al. U.S. Pat. No. 4,134,882. It will be understood that other conditions can be used, e.g., other designs of orifice, such as are shown by Gorrafa, U.S. Pat. No. 3,914,488.

EXAMPLE 1

Figure 2:
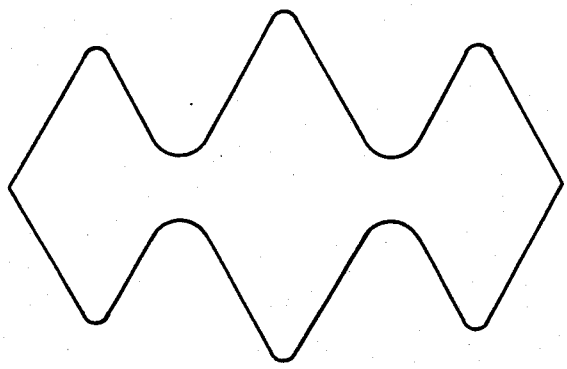
FIG. 2 shows a typical spinneret orifice for spinning filaments of feed yarns of the invention.

A 175 (110)-68 polyester semi-dull feed yarn of tenacity 2.4 gpd and elongation 126% is prepared by spinning 68 filaments of poly(ethylene terephthalate) of relative viscosity about 21 and $TiO_2$ content 0.3% at 3033 ypm using spinneret orifices essentially as shown in FIG. 2, being of 3 diamond-shaped units joined by slots, and using a metering plate above the orifice plate, but otherwise using conventional techniques.

The feed yarn is draw-textured at a draw ratio of 1.61× on a Barmag FK6-9L, using Kyocera standard ceramic discs (0-8-1 stack), at a speed of 572 m/min, D/Y ratio 2.04, and a single heater at 180° C., to give a textured yarn of 110 denier, tenacity 2.89 gpd and elongation 14%.

The textured yarn is prepared for warping and slashing by twisting 3 turns per inch in the "Z" direction, followed by standard silk system warping and slashing.

This warp yarn (110 ENDS) is woven on a Crompton-Knowles S-6 loom to give 2×1 Oxford shirting fabrics with the following spun yarns as fillings:

A—40/1 cc cotton (62 picks)
B—35/1 cc T-891 (54 picks)
C—16/1 cc T-891 (44 picks)
D—18/1 cc T-54 (44 picks)

where T-891 is the designation for polyester staple of essentially similar scalloped-oval cross-section and 1.5 dpf and T-54 is the designation for polyester staple of round cross-section and 1.5 dpf.

The fabrics are then finished under standard conditions, by open-width scouring and pre-setting at 160° C., and beck-dyed, followed by heat-setting at 171° C., and shearing, each setting step being for 45 seconds.

These fabrics have very pleasing overall aesthetics, similar to natural (all-cotton) fabrics, having a pleasing soft luster, and having a more natural appearance and a better cotton-like hand than four similar respective fabrics made using 100-34 clear yarn textured from filaments of trilobal cross section.

Because the comparison filaments are clear and of larger dpf (almost 3), the low denier scalloped-oval filament yarns are next compared in fabrics with yarns having filaments similar in all respects except cross-section, as can be seen in Example 2.

EXAMPLE 2

In this Example four similar fabrics are made and compared, following essentially the procedure of Example 1, with a 40/1 cc 100% staple T-891 (scalloped-oval) spun yarn each time as filling (55 picks), and the following different warps:-

Figure 3:
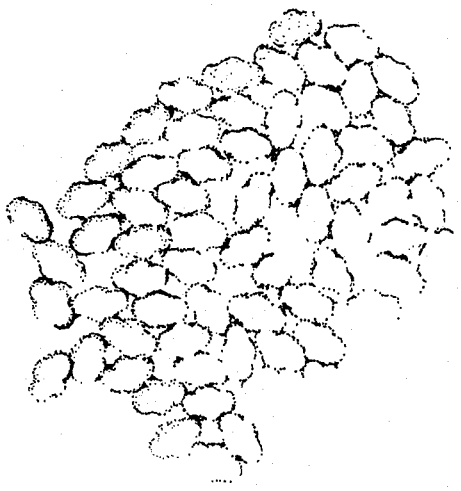
FIGS. 3 to 15 show photomicrographs of filament cross-sections, all being of 420× magnification, except for FIG. 9 which is of 290×, and FIGS. 12 to 15 being of about 400×.
Figure 4:
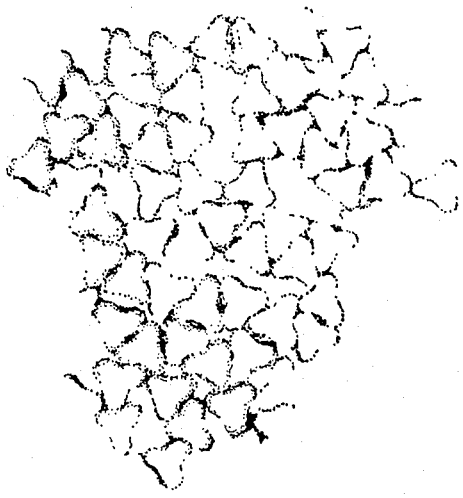
Figure 5:
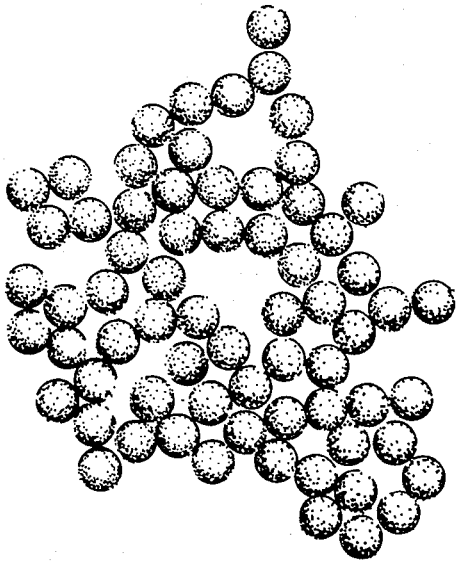

A—100% staple T-891 spun yarn.
B—110-68 textured continuous filament yarn, from scalloped-oval cross-section feed yarn (FIG. 3).
C—110-68 textured continuous filament yarn, from trilobal cross-section feed yarn (FIG. 4).
D—110-68 textured continuous filament yarn, from round cross-section feed yarn (FIG. 5).

This time the feed yarn of the invention (for Fabric B) is a 175-(110)-68 yarn of tenacity 2.68 gpd and elongation 122%. The scalloped-oval cross-section is clearly seen from the photomicrograph in FIG. 3, in contrast with the cross-sections in FIGS. 4 and 5 for the comparison feed yarns (C of trilobal cross-section and D of round cross-section).

The draw-texturing is carried out with polyurethane discs (1-5-1 stack) under substantially equivalent conditions (to match the pre-tensions, which required differences in machine settings) as can be seen from the equivalent crimp contraction values ($CCA_5$) for the resulting textured yarns: 3.5 for B and D and 3.8 for C. The heater temperatures were 190° C. for C and D and 185° C. for B. These temperatures provide less distortion, and so less bulk, than would higher bulking temperatures.

Of the three combo fabrics, Fabric B of the invention has the best aesthetics, having a much softer hand and a better natural luster (without objectionable glitter) than comparison Fabric C (trilobal), which has an undesirable brassy look associated hitherto with textured yarn fabrics. Comparison Fabric D (round) has a softer hand than C, but even more glitter, and Fabric B of the invention again has superior aesthetics, both in softer hand and particularly in having a better natural luster (without glitter) than Fabric D.

As compared with Comparison Fabric A (100% spun), Fabric B of the invention has a similar soft hand and pleasing enhanced natural luster. Because of the continuous filament content, Fabric B has a cleaner, more uniform look, more stretch, better wash/wear wrinkling performance, and reduced pilling tendency, and is a better fabric to process for finishing techniques. An advantage of the continuous filament content of Fabric B is the better ability to retain integrity when undergoing calendering or caustic treatments, as compared with Fabric A of 100% spun yarn. It should be emphasized that both Fabrics B and A have desirable (but different) aesthetics.

Similar results are obtained when T-54 (round cross-section) staple is used for the spun yarn filling.

Figure 6:
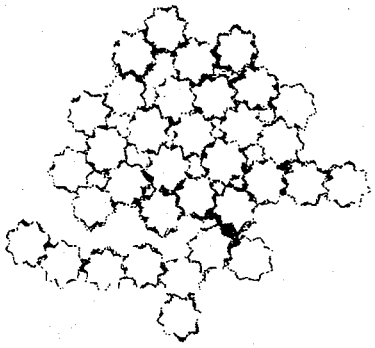
Figure 7:
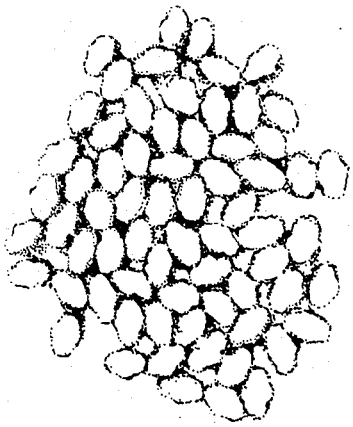

For comparison with FIGS. 3, 4 and 5, different cross-sections are also shown in FIGS. 6 and 7. FIG. 6 shows octalobal cross-sections providing glitter-free textured yarn fabrics but with inferior luster and hand (softness). FIG. 7 shows oval (i.e., with insufficient scalloping) cross-sections providing soft textured yarn fabrics but with pronounced glitter and an undesirable luster. Both are inferior with respect to fabrics of the invention.

Figure 12:
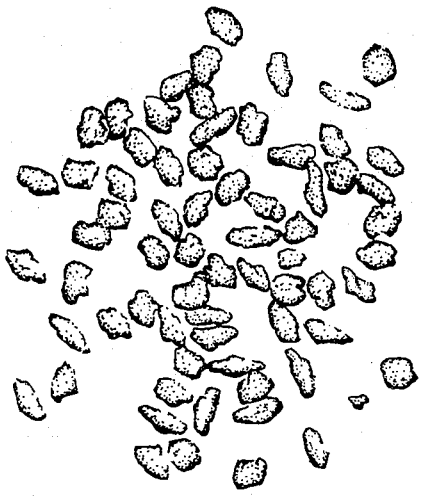
Figure 13:
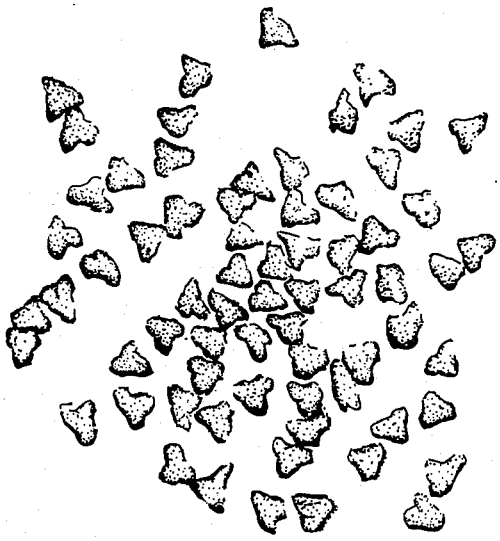
Figure 14:
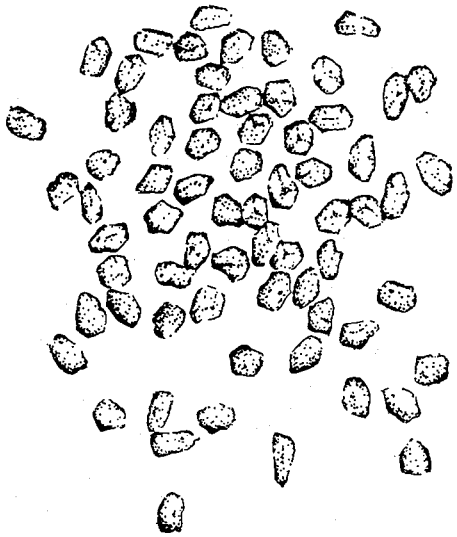
Figure 15:
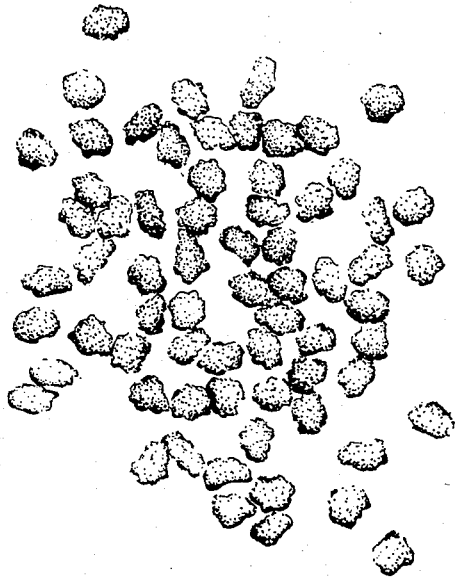

FIGS. 12 to 15 all show photomicrographs of textured yarns, and are included to show the distortion caused by draw-texturing feed yarn filaments of different cross-sections, as follows: FIG. 12 is the scalloped-oval of the invention (Example 2-B); FIG. 13 is the trilobal comparison (Example 2-C); FIG. 14 is the round comparison (Example 2-D); Example 15 is an octalobal comparison (FIG. 6). When these Figures are compared, for instance FIGS. 12 and 14, the advantage obtained in fabrics from using a scalloped-oval cross-section is surprising.

EXAMPLE 3

As a further comparison, poplin weave fabrics (4.4 oz/sq. yd., 108 ends×64 picks, in finished condition) were made using continuous filament draw-textured yarns (both from scalloped-oval cross-section filament feed yarns) as warps and a spun yarn (22 singles from a blend of 50/50 cotton/polyester, T-54 round cross-section) as filling. The fabrics were identical except for the dpf of the textured yarns used as warps. The preferred fabric contained a 150-68 warp yarn (2.2 dpf), whereas the other contained a 150-34 warp yarn (4.4 dpf). The lower dpf preferred fabric of the invention showed advantages in hand and in having less glitter. Thus the preferred fabric showed more natural characteristics in all three respects, i.e., showed the desired balance of luster, hand and absence of glitter, all of which are needed to achieve this "natural look" objective.

Figure 8:
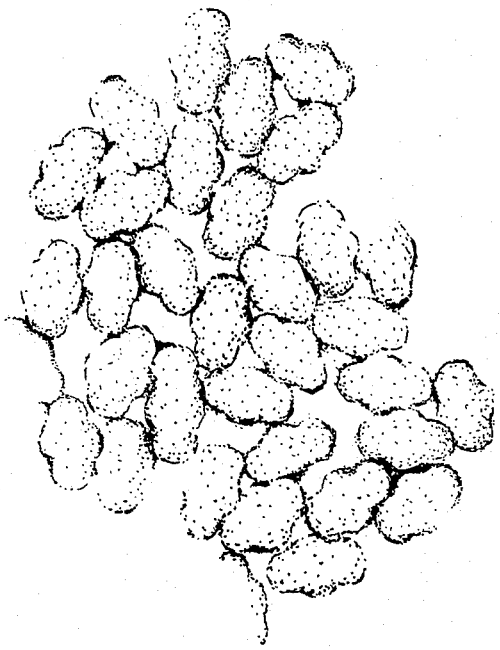
Figure 9:
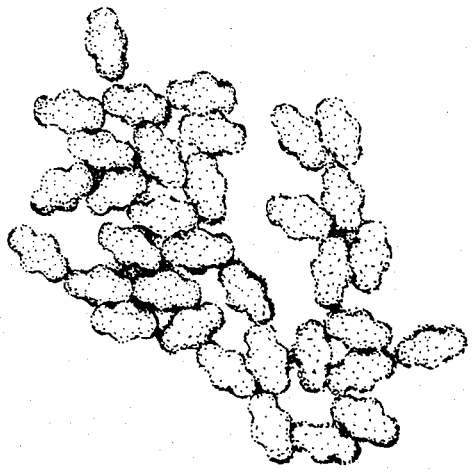
Figure 10:
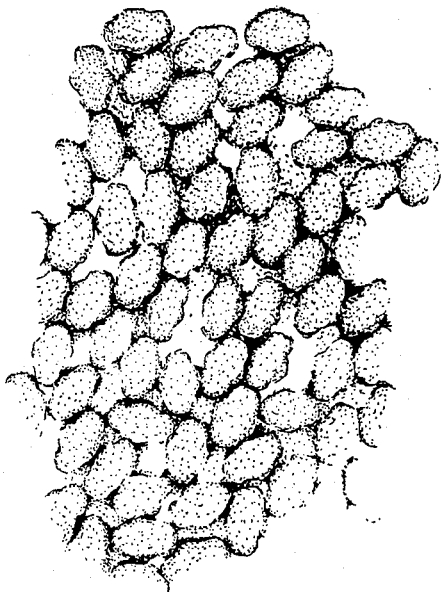
Figure 11:
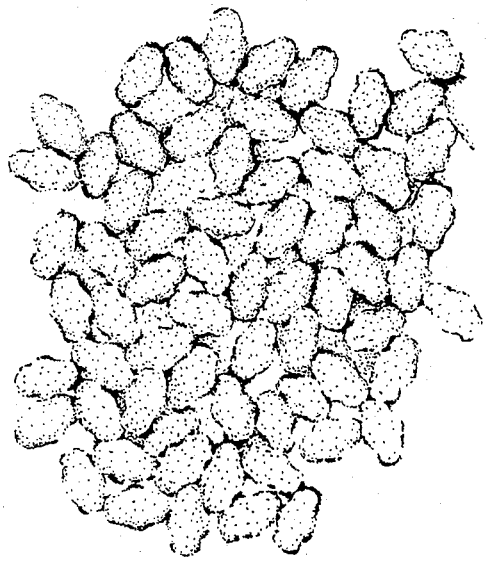

Photomicrographs of representative feed yarn filaments of scalloped-oval cross-section are shown in FIGS. 8 and 9 for 250(150)-34 feed yarns and in FIGS. 10 and 11 for 250(150)-68 feed yarns to show variations of such actual cross-sections. It will be noted that FIGS. 8 and 9 are according to the invention, whereas FIGS. 10 and 11 are outside, as will be explained.

The dimensions of representative scalloped-oval cross-sections of magnified feed yarn filaments from the Figures have been measured and averaged, and are set out in the Table at the end of the description. As can be seen from these cross-sections for scalloped-oval filaments of the invention, average dimensions are generally within the following ranges: A/B from 1.4 to 2.4, particularly 1.5 to 2.0, and especially from 1.6 to 1.8; $r_1/R$ from 0.2 to 0.45, especially from 0.35 to 0.45; $r_2/r_1$ from 0.8 to 2.1, particularly from 1.2 to 2.0, and especially from 1.4 to 1.8; $d/r_1$ from 1.2 to about 2, and especially from 1.6 to 2.0. FIGS. 10 and 11 show $d/r_1$ ratios that are significantly above 2.0, and so are insufficiently scalloped as to give the desired results.

For ease of initial preparation, the above combo fabrics were made with the textured yarns as warps, but it will be understood that the textured yarns may be used instead as fillings, and some fabric manufacturers prefer this arrangement. Furthermore, 100% continuous filament textured yarn fabrics may be made, as shown in Example 4.

EXAMPLE 4

A napery plain weave fabric (5.61 oz/sq.yd.) is made with 58 ends/inch of warp and 53 ends/inch of filling, both warp and filling being standard 2-ply of similar 150-68 continuous filament textured yarns prepared from feed yarn filaments of scalloped-oval cross-section according to the invention. This is compared with a similar fabric prepared from yarn textured from feed yarn filaments of round cross-section. The fabric of the invention (scalloped-oval cross-section) looks more like linen, and is judged to be excellent for tabelcloths.

Other counts include 250(150)-68 and 175(110)-100 scalloped-oval cross-section yarns. Variations can be obtained by using the filament yarn as the filling and the spun yarns as the warp, and by varying the amount of polyester/cotton in a blend in the spun yarn, and changing the cross-section of the staple fiber, using clear yarns (little or no $TiO_2$) and varying the amount of delusterant, as mentioned before.

The invention has been described in the Examples only with respect to homopoly(ethylene terephthalate), but similar advantages are noted when using copolymers. Especially useful copolymers are those having cationic dyeability by reason of the presence of sulfonic groups, especially copolyesters containing about 2 mole % of 5-sodium-sulfo-isophthalate units in the polymer chain, as described in Griffing et al., U.S. Pat. No. 3,018,272. Other copolyesters may be used, as described in the art.

TABLE

| | | A/B | $r_1/R$ | $r_2/r_1$ | $d/r_1$ |
|---|---|---|---|---|---|
| FIG. 8 | 1 | 1.70 | 0.42 | 1.39 | 1.77 |
| 250-34 | 2 | 1.67 | 0.38 | 1.58 | 1.90 |
| | 3 | 1.64 | 0.37 | 1.64 | 1.76 |
| | 4 | 1.56 | 0.43 | 1.50 | 1.86 |
| | 5 | 1.70 | 0.38 | 1.53 | 2.00 |
| | Average | 1.65 | 0.40 | 1.53 | 1.86 |
| | Sigma | 0.06 | 0.03 | 0.09 | 0.10 |
| FIG. 9 | 1 | 1.60 | 0.42 | 1.50 | 1.88 |
| 250-34 | 2 | 1.66 | 0.37 | 1.61 | 1.94 |
| | 3 | 1.62 | 0.39 | 1.57 | 1.82 |
| | 4 | 1.58 | 0.42 | 1.52 | 1.82 |
| | 5 | 1.66 | 0.41 | 1.45 | 1.82 |
| | Average | 1.62 | 0.40 | 1.53 | 1.86 |
| | Sigma | 0.04 | 0.02 | 0.06 | 0.05 |
| FIG. 10 | 1 | 1.61 | 0.38 | 1.63 | 2.21 |
| 250-68 | 2 | 1.67 | 0.36 | 1.65 | 2.35 |
| | 3 | 1.55 | 0.40 | 1.61 | 2.22 |
| | 4 | 1.59 | 0.41 | 1.53 | 2.42 |
| | 5 | 1.59 | 0.35 | 1.81 | 2.38 |
| | Average | 1.60 | 0.38 | 1.65 | 2.32 |
| | Sigma | 0.04 | 0.03 | 0.10 | 0.10 |
| FIG. 11 | 1 | 1.66 | 0.40 | 1.50 | 2.00 |
| 260-66 | 2 | 1.68 | 0.32 | 1.88 | 2.27 |
| | 3 | 1.68 | 0.36 | 1.67 | 2.00 |
| | 4 | 1.78 | 0.29 | 1.93 | 2.28 |
| | 5 | 1.62 | 0.34 | 1.82 | 2.13 |
| | Average | 1.68 | 0.34 | 1.76 | 2.14 |
| | Sigma | 0.06 | 0.04 | 0.18 | 0.14 |
| FIG. 3 | 1 | 1.70 | 0.38 | 1.55 | 1.95 |
| 175-68 | 2 | 1.70 | 0.38 | 1.55 | 1.79 |
| | 3 | 1.70 | 0.38 | 1.55 | 1.92 |
| | 4 | 1.68 | 0.43 | 1.37 | 1.78 |
| | 5 | 1.89 | 0.42 | 1.26 | 1.88 |
| | Avevage | 1.73 | 0.40 | 1.46 | 1.86 |
| | Sigma | 0.09 | 0.02 | 0.13 | 0.08 |

I claim:

1. An improved combination woven fabric, comprising textured continuous filament polyester warp yarns in combination with spun filling yarns, the improvement characterized in that said textured continuous filament polyester yarns comprise filaments of denier about 1 to about 4.5 derived by draw-texturing feed yarn filaments of elongation to break about 80 to 180% and of scalloped-oval cross-section with average dimensions within the following ranges: A/B from 1.4 to 2.4; $r_1/R$ from 0.2 to 0.45; $r_2/r_1$ from 0.8 to 2.1; $d/r_1$ from 1.2 to about 2; whereby the fabric has the combination of a soft hand and natural luster without objectionable glitter.

2. A fabric as claimed in claim 1, characterized in that said textured yarns have a denier per filament of about 1 to about 2.5.

3. An improved combination woven fabric, comprising textured continuous filament polyester filling yarns in combination with spun warp yarns, the improvement characterized in that said textured continuous filament polyester yarns comprise filaments of denier about 1 to about 4.5 derived by draw-texturing feed yarn filaments of elongation to break about 80 to 180% and of scalloped-oval cross-section with average dimensions within the following ranges: A/B from 1.4 to 2.4; $r_1/R$ from 0.2 to 0.45; $r_2/r_1$ from 0.8 to 2.1; $d/r_1$ from 1.2 to about 2; whereby the fabric has the combination of a soft hand and natural luster without objectionable glitter.

4. A fabric as claimed in claim 3, characterized in that said textured yarns have a denier per filament of about 1 to about 2.5.

* * * * *